US008246198B2

(12) United States Patent
Zheng

(10) Patent No.: US 8,246,198 B2
(45) Date of Patent: Aug. 21, 2012

(54) LED LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 426 days.

(21) Appl. No.: 12/694,202

(22) Filed: Jan. 26, 2010

(65) Prior Publication Data

US 2011/0103052 A1 May 5, 2011

(30) Foreign Application Priority Data

Oct. 29, 2009 (CN) ..... 2009 1 0309066

(51) Int. Cl.
*F21V 1/00* (2006.01)
*F21V 7/00* (2006.01)

(52) U.S. Cl. ..... 362/235; 362/294; 362/307; 362/328

(58) Field of Classification Search ..... 362/235, 362/294, 247, 296.05, 296.07, 307, 299, 362/300, 311.02, 327, 328, 362, 373, 800
See application file for complete search history.

(56) References Cited

U.S. PATENT DOCUMENTS

2006/0176702 A1* 8/2006 Shen et al. ..... 362/311
2011/0044033 A1* 2/2011 Zheng ..... 362/183

* cited by examiner

*Primary Examiner* — Bao Q Truong

(74) *Attorney, Agent, or Firm* — Altis Law Group, Inc.

(57) ABSTRACT

An LED lamp includes a housing, multiple LEDs received in a first end portion of the housing, an envelope having a first end portion inserted in the housing and having a second end portion extending beyond a second end portion of the housing, and a reflector covering the second end portion of the envelope and having a reflective surface facing the LEDs. The LEDs encircle the first end portion of the envelope. The second end portion of the envelope spaces a distance from the second end portion of the housing to define a window at the second end portion of the envelope. Light generated by the LEDs permeates the envelope and impinges on the reflective surface, and the light is reflected by the reflective surface to emit out of the housing from the window, thereby illuminating an annular region around the housing.

19 Claims, 3 Drawing Sheets

LED LAMP

BACKGROUND

1. Technical Field

The disclosure relates to an illuminating device and, more particularly, to an LED (light emitting diode) lamp.

2. Description of Related Art

An LED lamp is a type of solid-state lighting that utilizes LEDs as a source of illumination. The LED lamp is intended to be a cost-effective yet high quality replacement for incandescent and fluorescent lamp because the LED has features of long-term reliability, environment friendliness and low power consumption.

Generally, light emitted from the LEDs has a high directivity. However, It is uncomfortable for viewers to directly view the LED lamp. The light needs to be spread, yet still sufficiently illuminate a subject area.

What is needed, therefore, is an LED lamp having spread light which can sufficiently illuminate a subject area.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
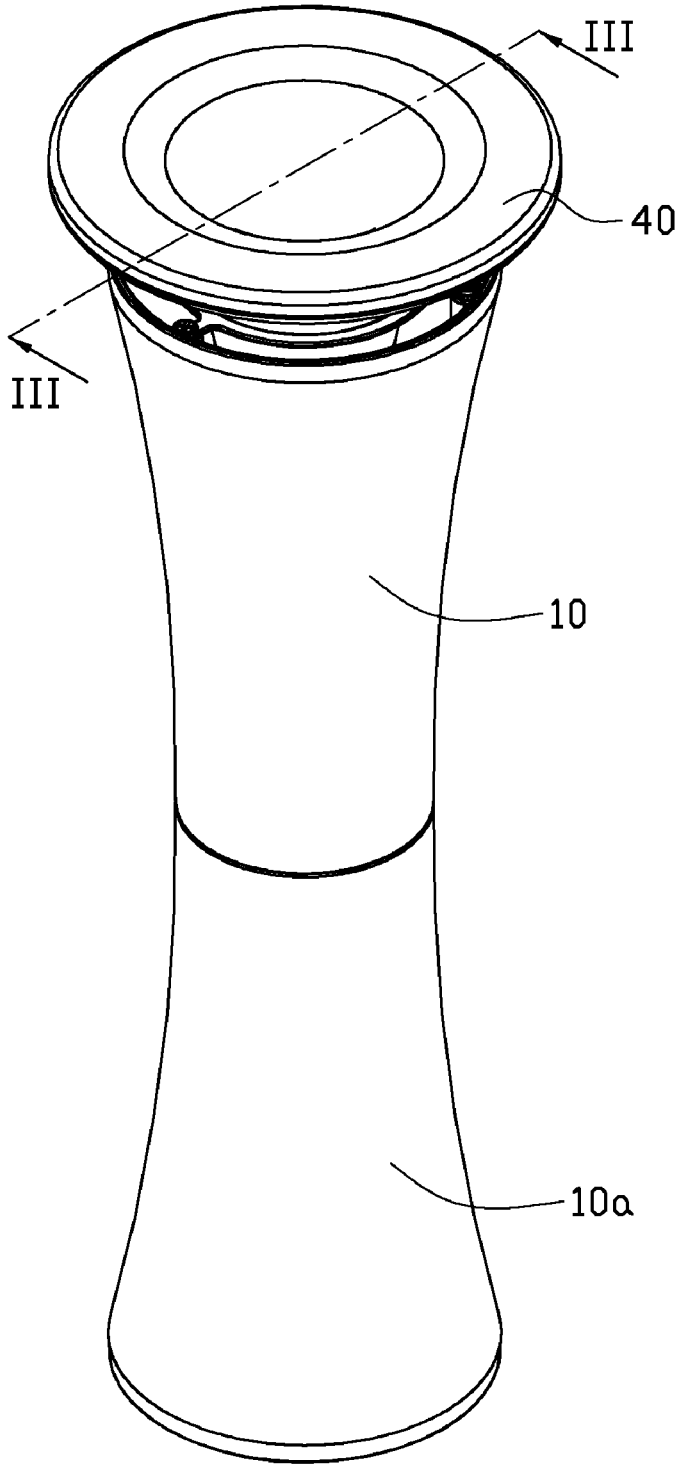
FIG. 1 is an isometric, assembled view of an LED lamp in accordance with an embodiment of the disclosure.
Figure 2:
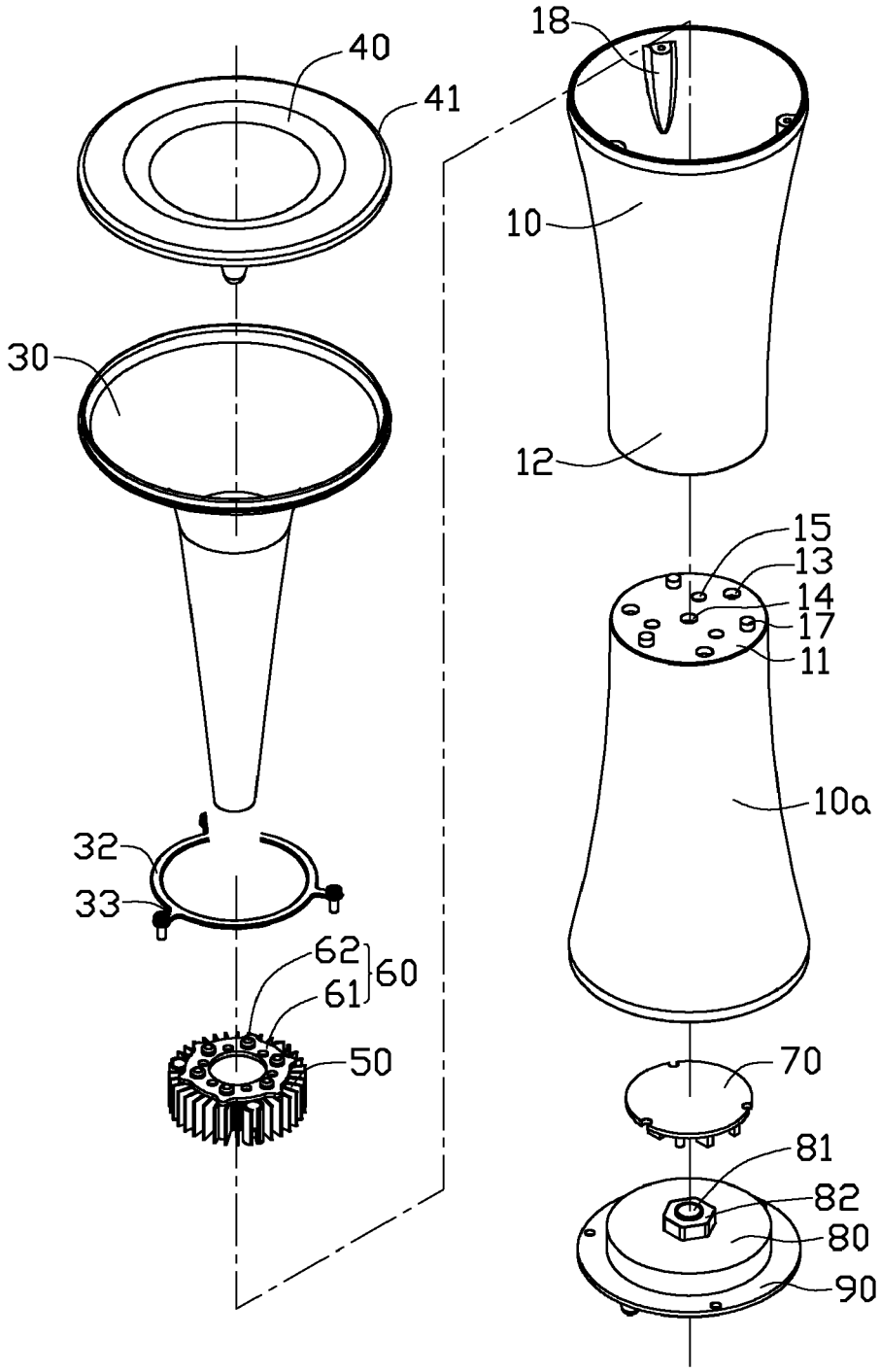
FIG. 2 is an isometric, exploded view of the LED lamp of FIG. 1.

Referring to FIGS. 1-2, an LED (light emitting diode) lamp is illustrated in accordance with an embodiment of the disclosure, and is generally used as a reading lamp or an indoor supplementary light source. The LED lamp includes a first housing 10, a second housing 10*a* having a configuration similar to the first housing 10 and invertedly joining with a bottom of the first housing 10, an envelope 30 having a bottom end thereof inserted into the first housing 10 and a top end thereof over the first housing 10, and a reflector 40 covering the top end of the envelope 30. A heat sink 50 is received in the first housing 10 and is positioned on a bottom portion of the first housing 10. An LED module 60 is attached to a top surface of the heat sink 50. A driver 70 for converting an AC current to a DC current and supplying power to the LED module 60 is received in the second housing 10*a*. The top end of the envelope 30 is located above the first housing 10. The top end of the envelope 30 is spaced a distance from a top end of the first housing 10 to define an annular window 35 thereof, which is located above the top end of the first housing 10. Light generated by the LED module 60 is first reflected by the reflector 40 and then radiates through the window 35 of the envelope 30 to illuminate a subject area which is required to be illuminated by the LED lamp.

Figure 3:
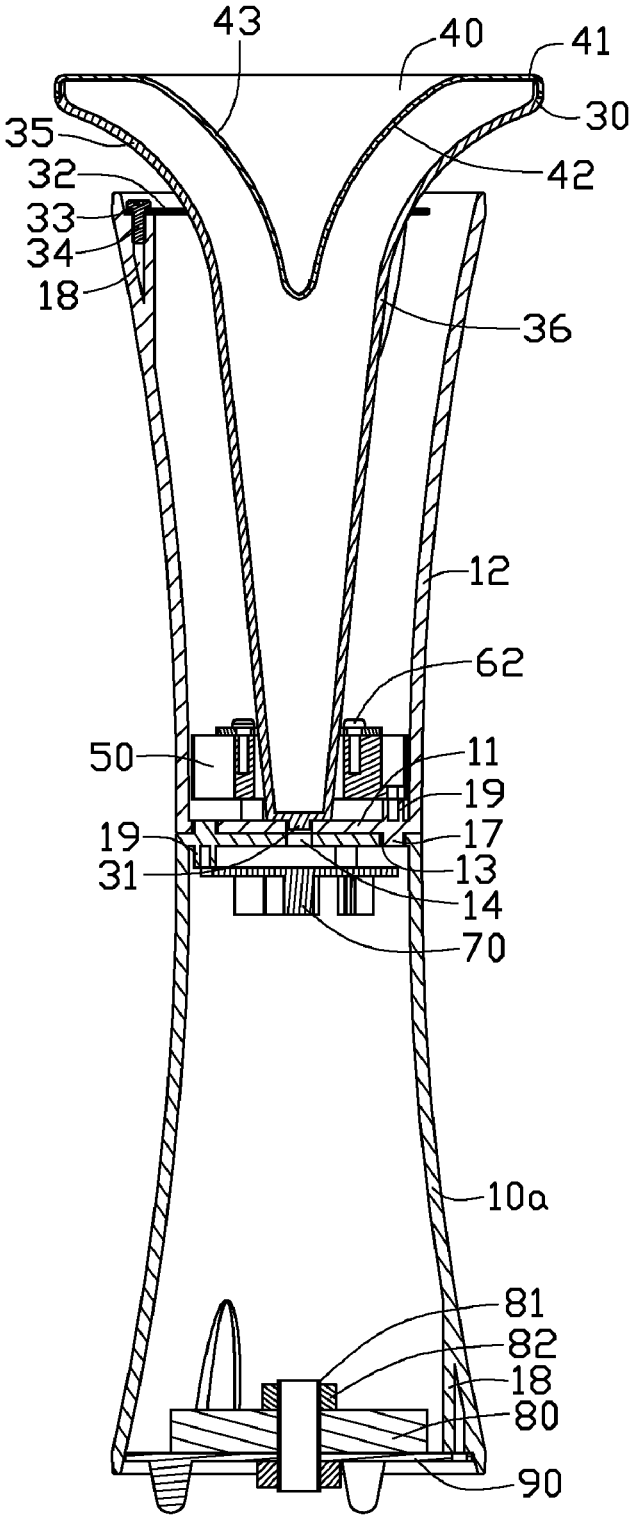
FIG. 3 is a cross-section of the LED lamp of FIG. 1, taken along line III-III thereof.

In this embodiment, the first and second housings 10, 10*a* are the same as each other. In other embodiments, the first housing 10 may be different from the second housing 10*a*. Also referring to FIG. 3, in this embodiment, each of the first and second housings 10, 10*a* includes a bottom plate 11, and a hollow cylinder 12 extending upwardly from a periphery of the bottom plate 11. Diameter of the hollow cylinder 12 is gradually wider from bottom to top. The bottom plate 11 defines evenly a plurality of through holes 13 along a circumferential edge of the bottom plate 11 and near the circumferential edge. The bottom plate 11 defines a positioning hole 14 in a center thereof, and defines evenly a plurality of extending holes 15 along the circumferential edge of the bottom plate 11 and between the positioning hole 14 and the through holes 13. In this embodiment, an amount of the through holes 13 is identical to that of the extending hole 15, and the amount is three. The through holes 13 and the extending holes 15 are arranged in alternating fashion along the circumferential edge of the bottom plate 11. In other embodiments, the through holes 13 and the extending hole 15 may be arranged with other quantities and other positioning relationships, such as the through holes 13 and the extending holes 15 are arranged in a line with the positioning hole 14, according to actual needs.

A plurality of positioning poles 17 extend downwardly from a bottom surface of the bottom plate 11. The positioning poles 17 are spaced from each other along a circumferential direction of the bottom plate 11, and close to the circumferential edge of the bottom plate 11. A plurality of mounting poles 19 extend upwardly from a top surface of the bottom plate 11. The mounting poles 19 are spaced from each other along the circumferential direction of the bottom plate 11, and close to the circumferential edge of the bottom plate 11 and accordingly the hollow cylinder 12. The heat sink 50 is mounted on the mounting poles 19 of the first housing 10 via fasteners (not shown). The driver 70 is mounted on the mounting poles 19 of the second housing 10*a*. The positioning poles 17 of the first housing 10 rivet in corresponding through holes 13 of the second housing 10*a*, and the positioning poles 17 of the second housing 10*a* rivet in corresponding through holes 13 of the first housing 10, whereby the first housing 10 is invertedly secured to the bottom plate 11 of the second housings 10*a*. In other embodiments, the positioning poles 17 may be engaged in corresponding through holes 13 by means of interference fit.

A plurality of mounting portions 18 are protruded inwardly from of an inner surface of the top end of the first housing 10. The mounting portions 18 are evenly spaced from each other along a circumferential direction of the hollow cylinder 12. A positioning ring 32 is horizontally secured to the mounting portions 18 of the first housing 10. A supporting base 90 is horizontally secured to the mounting portions 18 of the second housing 10*a*. The positioning ring 32 has a plurality of securing portions 33 extending outwardly from an outer circumferential edge thereof. An amount of the securing portions 33 is identical to that of the mounting portions 18 of the first housing 10, and the amount is three. The securing portions 33 are secured to corresponding mounting portions 18 of the first housing 10 via screws 34. A weight 80 is located on the supporting base 90 so that the LED lamp can be stably positioned at a desired place. A hollow threaded pole 81 extends through the supporting base 90 and the weight 80, and has two opposite ends extending beyond the supporting base 90 and the weight 80. Two nuts 82 are respectively engaged with the two opposite ends of the hollow threaded pole 81, thereby securing the weight 80 to the supporting base 90.

The envelope 30 is a substantially funnel-shaped shell, having an opening (not labeled) at the top end thereof and having a neck near the top end fitted in the positioning ring 32. The bottom end of the envelope 30 is a close bottom end. A transverse cross section of the envelope 30 is round. A diameter of the transverse cross section of the envelope 30 gradually becomes smaller from the top end to the bottom end of the envelope 30. Change rate of the transversely cross-sectional diameter from the top end to the neck of the envelope 30 is larger than that from the neck to the bottom end of the envelope 30 so that the hollow cylinder 12 defines a concave portion 36 at the neck of the envelope 30. The bottom end of the envelope 30 protrudes downwardly a protruding pole 31 therefrom. The bottom end of the envelope 30 extends through the positioning ring 32 into the first housing 10, and then extends through the heat sink 50 and the LED module 60 to have the protruding pole 31 inserted into the positioning hole 14 of the bottom plate 11 of the first housing 10, thereby positioning the bottom end of the envelope 30 in position. At the same time, the positioning ring 32 engages around the neck of the envelope 30 to support and position the envelope 30. The envelope 30 is integrally made of a light-permeable material. The envelope 30 may be without color and with different colors, according to the actual requirement. When the envelope 30 is with color, light generated by the LED module 60 is modulated by the envelope 30 to generate a different color.

The reflector 40, viewed from the cross section, has a hollow, V-shaped configuration, progressively narrower from a top to a bottom to form a tip at the bottom thereof. A top circumferential edge 41 of the reflector 40 is embedded in a top circumferential edge of the envelope 30. The tip of the reflector 40 extends into the envelope 30 and faces towards the bottom end of the envelope 30. The reflector 40 has an outer slantwise reflective surface 42 facing the LED module 60 for directing light generated by the LED module 60 to illuminating a periphery of the LED lamp via the window 35 of the envelope 30. The concave portion 36 of the envelope 30 surrounds the outer slantwise reflective surface 42 of the reflector 40. The outer slantwise reflective surface 42 is coated with a layer of light-reflecting substance to achieve better reflection. In this embodiment, the outer slantwise reflective surface 42 is a smoothly concave, curved surface. In other embodiments, the outer slantwise reflective surface 42 may be a cone-shaped reflective surface 42. In this embodiment, the reflector 40 has a central axis (not shown). The outer slantwise reflective surface 42 is symmetrical about the central axis of the reflector 40. The reflector 40 is coaxial with the envelope 30 and the first housing 10. The reflector 40 has an inner surface 43 opposite to the outer reflective surface 42. The inner surface 43 may be processed so that it has a surface decoration effectiveness. For example, the inner surface 43 may be sandblasted so that it has a frosted appearance.

The heat sink 50 is made of material with high heat conductivity by extrusion process. The heat sink 50 is substantially columnar, defining a central hole (not labeled) in a center thereof. A plurality of fins (not labeled) extend outwardly from the heat sink 50. The LED module 60 includes a substantially annular printed circuit board 61, and a plurality of LEDs 62 attached to the printed circuit board 61. When the bottom end of the envelope 30 extends through the LED module 60 and the central hole of the heat sink 50, the fins and the LEDs 62 encircle the bottom end of the envelope 30. An electric wire (not labeled) connected to the driver 70 extends through the extending holes 15 of the second housing 10*a* and corresponding extending holes 15 of the first housing 10 in sequence to electrically connect with the printed circuit board 61. A supply line (not labeled) connected to the driver 70 extends through the hollow threaded pole 81 to connect with an external power. In this embodiment, the LEDs 62 are evenly arranged in a supposed circle which surrounds the envelope 30. The central axis of the reflector 40 extends through the center of the supposed circle of the LEDs 62, so that the light generated by the LED module 60 evenly projects on the outer slantwise reflective surface 42, and is evenly reflected towards the periphery of the LED lamp. In other embodiments, the LEDs 62 may be gathered up at a partial region of the supposed circle, and correspondingly, the reflector 40 is a unsymmetrical part, providing a larger outer slantwise reflective surface 42 corresponding to the intensively arranged LEDs 62 to reflect most of the light generated by the LED module 60 towards a side of the LED lamp.

In use of the LED lamp, the light generated by the LED module 60 permeates a part of the concave portion 36 of the envelope 30 which is received in the first housing 10, and impinges on the outer slantwise reflective surface 42 of the reflector 40. The light is reflected from the outer slantwise reflective surface 42 and permeating the window 35 of the envelope 30 to illuminate a substantially annular region in the periphery of the LED lamp. When the LED lamp is located at a table, the light permeating the window 35 is well spread downwardly towards the table, avoiding discomfort for a user when directly viewing the LED lamp. Due to the reflector 40, a planar light source is converted into a three-dimensional light source which has a large illuminating angle. In addition, since the envelope 30 has the cross-sectional diameter gradually becoming smaller from the top end to the bottom end thereof and is mounted to the first housing 10 by having the neck between the top end and the bottom end fitted on the positioning ring 32, when the envelope 30 is needed to be replaced, it only requires the user to draw out the envelope 30 from the top end of the first housing 10, and then replace a new envelope. Such replacement can be conveniently completed.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp comprising:

a housing;

an envelope having a bottom end portion inserted in the housing and having a top end portion over the housing;

a plurality of LEDs being received in the housing and encircling the bottom end portion of the envelope; and a reflector covering the top end portion of the envelope and having a slantwise reflective surface facing the LEDs;

wherein light generated by the LEDs upwardly permeates a middle portion of the envelope and impinges on the slantwise reflective surface, and the light is reflected by the slantwise reflective surface to emit slantwise downwardly out of the housing from the top end portion of the envelope.

2. The LED lamp as claimed in claim 1, wherein the envelope has a cross-sectional diameter thereof gradually becoming smaller from the top end portion to the bottom end portion and has a neck between the top end portion and the bottom end portion.

3. The LED lamp as claimed in claim 2, wherein change rate of the cross-sectional diameter from the top end portion to the neck of the envelope is larger than that from the neck to the bottom end portion of the envelope.

4. The LED lamp as claimed in claim 2, further comprising a positioning ring mounted on a top portion of the housing and located in the housing, the neck of the envelope is fitted in the positioning ring to position the envelope in place.

5. The LED lamp as claimed in claim 1, wherein the slantwise reflective surface of the reflector is a concave reflective surface.

6. The LED lamp as claimed in claim 5, wherein the reflector is progressively wider from a bottom to a top thereof to form a tip facing towards the LEDs, the tip being received in the envelope.

7. The LED lamp as claimed in claim 1, wherein the reflector is coaxial with the envelope and the housing.

8. The LED lamp as claimed in claim 1, wherein the LEDs are evenly arranged in a supposed circle which surrounds the envelope, a central axis of the reflector extending through a center of the supposed circle.

9. The LED lamp as claimed in claim 1, wherein the bottom end portion of the envelope is positioned at a bottom portion of the housing.

10. The LED lamp as claimed in claim 1, further comprising a heat sink received in the housing and located at the bottom portion of the housing, the LEDs are attached to the heat sink, the heat sink encircling the bottom end portion of the envelope.

11. The LED lamp as claimed in claim 1, further comprising an additional housing, the additional housing having a configuration substantially the same as that of the housing, wherein the additional housing is inverted and joins a bottom of the housing.

12. The LED lamp as claimed in claim 11, wherein the additional housing has a weight received therein to stabilize the LED lamp in position.

13. The LED lamp as claimed in claim 11, further comprising a hollow threaded pole extending through the weight and a supporting base of the additional housing to connect the weight and the supporting base together.

14. An LED lamp comprising:

a housing;

a plurality of LEDs received in a first end portion of the housing;

an envelope having a first end portion thereof inserted in the housing and having a second end portion opposite to the first end portion thereof extending beyond a second end portion of the housing which is opposite to the first end portion of the housing, the LEDs encircling the first end portion of the envelope, the second end portion of the envelope spacing a distance from the second end portion of the housing to define a window; and a reflector covering the second end portion of the envelope and having a reflective surface facing the LEDs;

wherein light generated by the LEDs permeates the envelope and impinges on the reflective surface, and the light is reflected by the reflective surface to emit out of the housing from the window, illuminating an annular region encircling the housing.

15. The LED lamp as claimed in claim 14, wherein the reflective surface of the reflector comprises a concave reflective surface, and the envelope comprises a concave portion surrounding the concave reflective surface.

16. The LED lamp as claimed in claim 14, wherein the housing comprises a plate and a hollow cylinder extending from a periphery of the plate, the plate defining a positioning hole in a center thereof.

17. The LED lamp as claimed in claim 16, wherein the envelope disposes a protruding pole at the first end portion thereof, the protruding pole being inserted in the positioning hole of the plate of the housing.

18. The LED lamp as claimed in claim 16, further comprising a positioning ring disposed at the second end portion of the housing, the envelope has a neck between the first end portion and the second end portion thereof, the positioning ring fitting around the neck of the envelope.

19. The LED lamp as claimed in claim 16, further comprising an additional housing, the additional housing having the same configuration as the housing and having a plate, the plate of the housing being joined with the plate of the additional housing.

* * * * *